US011066868B2

(12) United States Patent
Linville et al.

(10) Patent No.: US 11,066,868 B2
(45) Date of Patent: Jul. 20, 2021

(54) DOUBLE EGRESS DOOR FRAME

(71) Applicant: The Dunbarton Group, Inc., Dothan, AL (US)

(72) Inventors: J. Ralph Linville, Dothan, AL (US); LaRon Reaves, Newville, AL (US); Doug Schroeder, Dothan, AL (US); Dave Goetzinger, Altoona, IA (US)

(73) Assignee: The Dunbarton Group, Inc., Dothan, AL (US)

( * ) Notice: Subject to any disclaimer, the term of this patent is extended or adjusted under 35 U.S.C. 154(b) by 0 days.

(21) Appl. No.: 17/060,735

(22) Filed: Oct. 1, 2020

(65) Prior Publication Data

US 2021/0189791 A1 Jun. 24, 2021

Related U.S. Application Data

(60) Provisional application No. 62/949,692, filed on Dec. 18, 2019.

(51) Int. Cl.

| | |
|---|---|
| ***E06B 1/18*** | (2006.01) |
| ***E06B 1/52*** | (2006.01) |
| *E06B 3/36* | (2006.01) |

(52) U.S. Cl.

CPC ..... *E06B 1/18* (2013.01); *E06B 1/52* (2013.01); *E06B 3/362* (2013.01)

(58) Field of Classification Search

None

See application file for complete search history.

(56) References Cited

U.S. PATENT DOCUMENTS

| | | | | | |
|---|---|---|---|---|---|
| 1,701,679 | A * | 2/1929 | Johnson | E06B 1/6038 | 52/215 |
| 2,309,452 | A * | 1/1943 | Hasenburger | E06B 1/6015 | 49/504 |
| 2,661,084 | A * | 12/1953 | Steffan | E06B 1/52 | 49/505 |
| 2,874,420 | A * | 2/1959 | Henderson | E06B 1/52 | 52/211 |
| 3,177,532 | A * | 4/1965 | Domsic | E06B 1/6092 | 49/381 |
| 3,676,966 | A * | 7/1972 | Ragland | E06B 1/6023 | 52/211 |
| 5,061,022 | A * | 10/1991 | Meriwether | E05F 5/12 | 312/324 |

(Continued)

*Primary Examiner* — Joshua K Ihezie

(74) *Attorney, Agent, or Firm* — Smith Gambrell & Russell LLP

(57) ABSTRACT

A double egress door frame has a channel-shaped header with upstanding sides connected by a central web. The central web has a first series of slots that are offset to one side of the central web and a second series of slots that are offset toward the opposite side of the central web. Door stops comprise a right elongated channel-shaped member and a left elongated channel-shaped member. The channel-shaped members are attached to the central web of the header by tabs extending from the sides of the channel-shaped members. The tabs engage the slots. Once the tabs have passed through the slots to the opposite side of the central web, the tabs are twisted thereby connecting the channel-shaped members to the central web. A spot weld is used to insure the door stops is permanently locked into position.

5 Claims, 5 Drawing Sheets

(56) References Cited

U.S. PATENT DOCUMENTS

| | | | | |
|---|---|---|---|---|
| 9,719,287 | B1 * | 8/2017 | Chapman | E05C 7/045 |
| 2004/0256858 | A1 * | 12/2004 | Governale | E05C 1/06 292/1 |
| 2008/0087052 | A1 * | 4/2008 | Abdollahzadeh | E05C 9/1883 70/93 |
| 2014/0265355 | A1 * | 9/2014 | Tien | E05B 17/2053 292/21 |
| 2017/0204652 | A1 * | 7/2017 | Clarke, Jr. | E06B 3/362 |
| 2017/0314320 | A1 * | 11/2017 | Giuliani | E06B 1/10 |
| 2018/0258684 | A1 * | 9/2018 | MacDonald | E06B 1/52 |
| 2020/0018112 | A1 * | 1/2020 | Coe | E06B 9/04 |
| 2020/0300009 | A1 * | 9/2020 | Miller | E05C 17/025 |

* cited by examiner

DOUBLE EGRESS DOOR FRAME

CROSS REFERENCE TO RELATED PATENT APPLICATIONS

This invention claims priority from U.S. Provisional Patent Application No. 62/949,692, filed Dec. 18, 2019, which is hereby incorporated by reference.

FIELD OF THE INVENTION

This invention relates to metal door frames and more particularly to a double egress door frame with a header having a separate left door stop and a separate right door stop.

BACKGROUND OF THE INVENTION

A double egress door frame, comprising a header, a left door jamb, and a right door jamb, supports two doors that swing in opposite directions. The double egress door frame and doors are employed to accommodate foot traffic moving in opposite directions such as in a hallway. When the doors swing shut, door stops for each door is provided on the header. Conventionally, the header for the double egress door frame is constructed from two standard header sections. Each header section has an integrally formed rabbet that serves as a door stop. In order to accommodate the left-hand swinging door and the right-hand swinging door, the two separate header sections are reversed with respect to each other and welded together in the middle. The result is a header that has first door stop rabbet offset to one side at one end of the header and a second door stop rabbet offset to the opposite side at the other end of the header. Such a construction process is time-consuming and requires a level of skill to assure that the resulting header is straight and properly sized. Moreover, because the intersections are joined by welding, the header material must be heavier then otherwise needed in order to withstand the warping effects of the welding heat.

SUMMARY OF THE INVENTION

In order to overcome the problem of creating a double egress door frame header from two separate welded header sections, the double egress door frame of the present invention employs a header that is formed from a single channel-shaped header member with upstanding sides connected by a central web. The central web has a first series of slots that are offset to one side of the central web and extend along a portion of the length of the central web. The web has a second series of slots that are offset toward the opposite side of the central web and extend along a portion of the length of the web.

In order to create door stops for the opposite swinging doors, a left elongated channel-shaped member forms a separate left door stop and a right elongated channel-shaped member forms a separate right door stop. The separate left door stop and the separate right door stop are attached to the underside of the central web of the header by means of tabs extending from the sides of the channel-shaped members forming the separate left door stop and the separate right door stop. The tabs of the left channel-shaped member engage the slots offset to one side of the central web, and the tabs of the right channel-shaped member engages the slots offset to the opposite side of the central web. Once the tabs have passed through the slots to the top side of the central web, the tabs are twisted so that the tabs cannot pull through the slots and thereby hold the channel-shaped door stop members in place on the underside of the central web. For added security, spot welds are made to connect the bent tabs to the central web.

Further objects, features and advantages will become apparent upon consideration of the following detailed description of the invention when taken in conjunction with the drawings and the appended claims.

DETAILED DESCRIPTION OF THE PREFERRED EMBODIMENTS

In connection with the following disclosure and claims, the terms "left", "right", "front", and "back" are used for the purposes of clarity and not as a limitation. For example, the terms could be interchanged for each other without changing the nature and scope of the invention.

Figure 1:
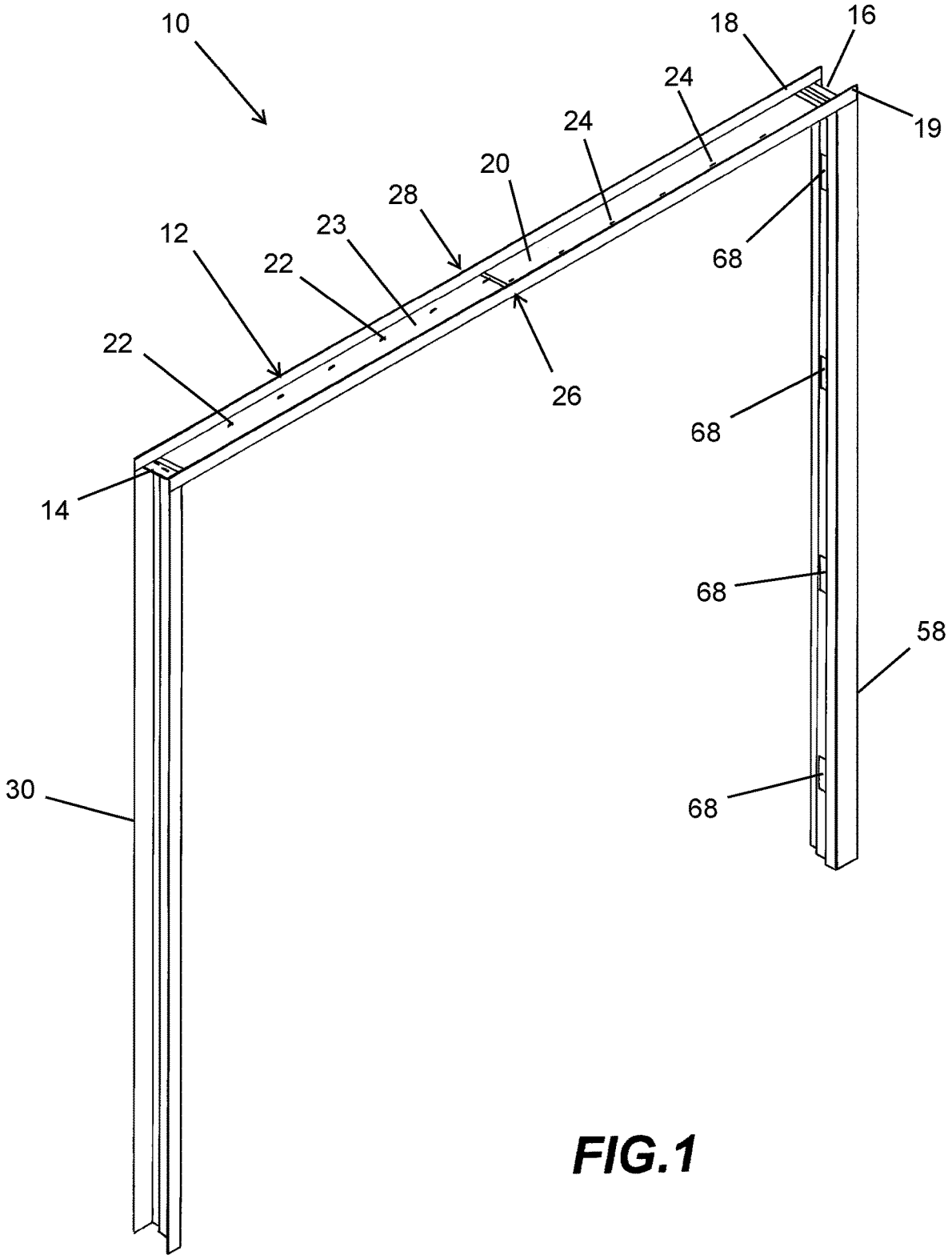
FIG. 1 is a front perspective view of a double egress door frame in accordance with the present invention.
Figure 2:
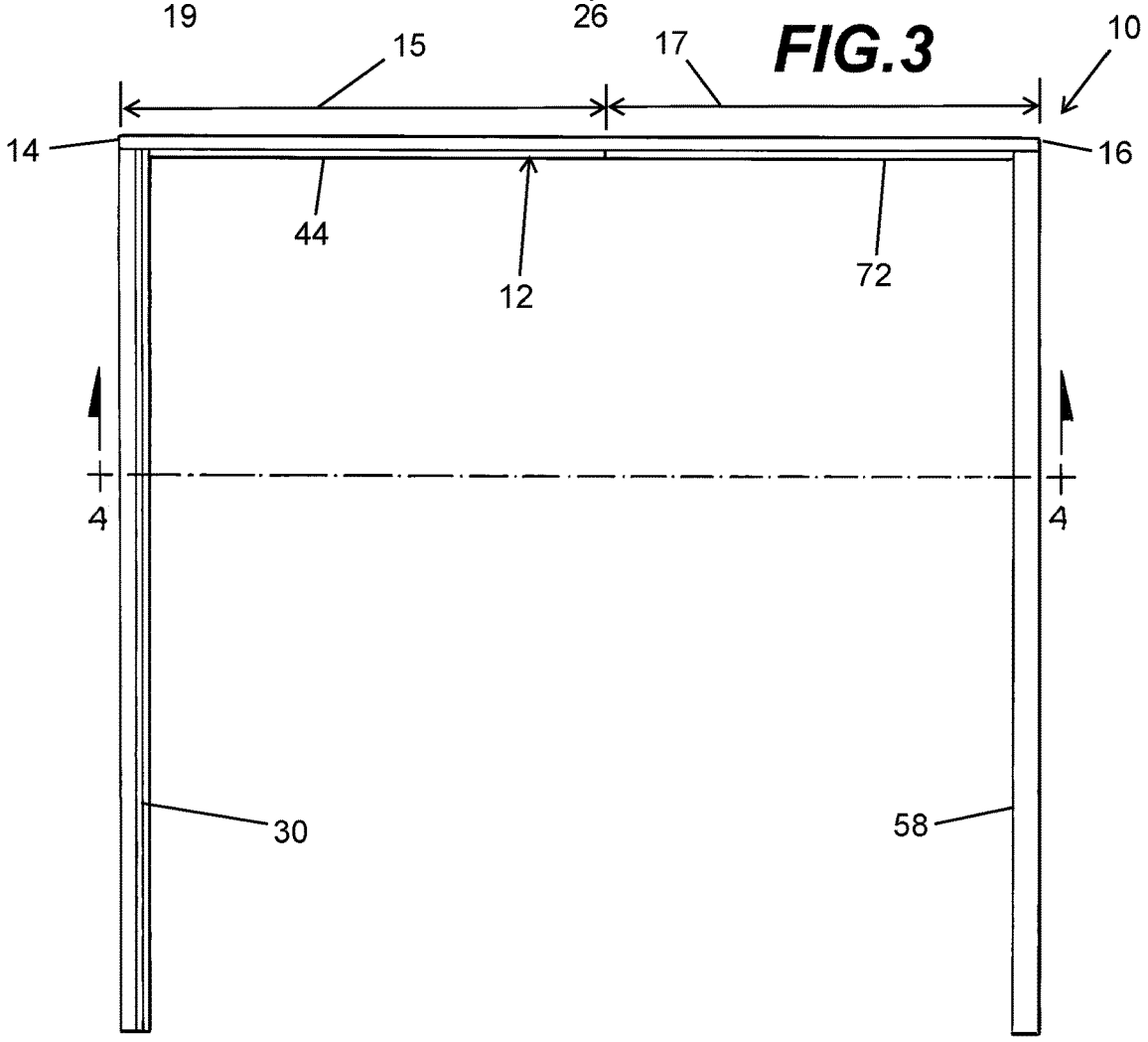
FIG. 2 is a front elevation view of the double egress door frame in accordance with the present invention.

Turning to the figures, FIGS. 1 and 2 show a double egress door frame 10 in accordance with the present invention. The double egress door frame 10 has a header 12, connected at its left end 14 to a left jamb 30 and at its right end 16 to a right jamb 58. The header 12 and the door frame 10 have a front 26 and a back 28. The left jamb 30 supports a left door (not shown) by means of hinges (not shown) positioned in mortises (not shown). The right jamb 58 supports a right door (not shown) by means of hinges (not shown) positioned in mortises 68. The right door swings toward the back 28 of the door frame 10. The left door swings toward the front 26 of the door frame 10.

Figure 3:
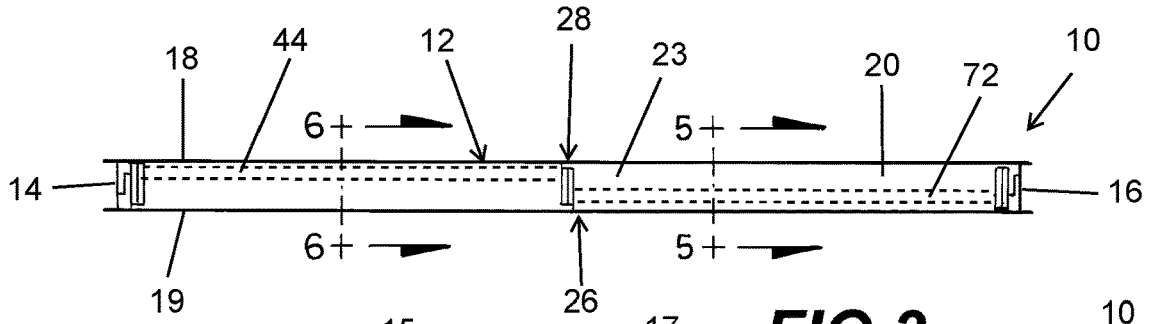
FIG. 3 is a top plan view of the double egress door frame in accordance with the present invention.
Figure 4:
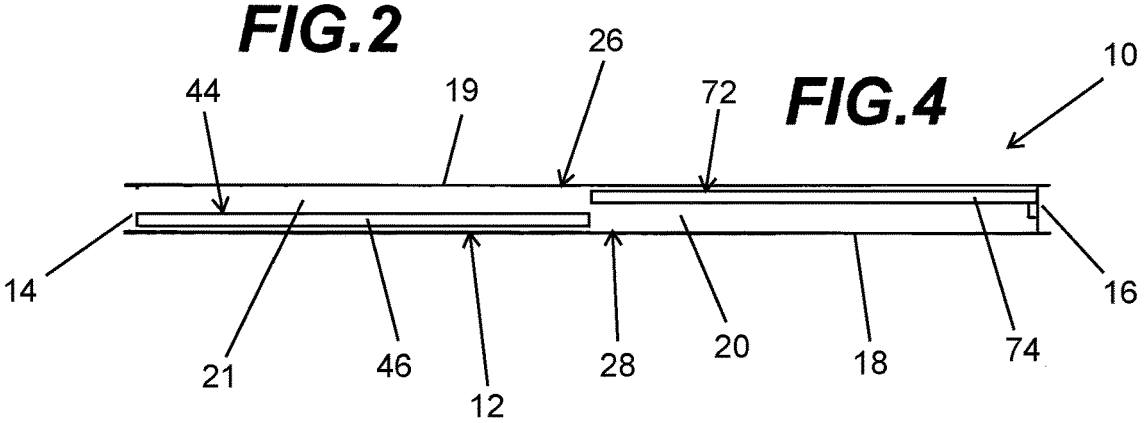
FIG. 4 is a section view of the double egress door frame as seen along line 4-4 of FIG. 2 in accordance with the present invention.

With reference to FIGS. 3 and 4, the header 12 is channel-shaped with a central web 20, an underside 21, the top side 23, a back channel side 18, and a front channel side 19. The header 12 has left door stop slots 22 positioned along a left header portion 15 and offset in a back width direction toward the back 28 of the header 10. The header 12 also has right door stop slots 24 positioned along a right header portion 17 and offset in a front width direction toward the front 26 of the header 10. The left door stop slots 22 are configured to secure a separate left door stop 44 to the underside 21 of the central web 20 of the header 12. The right door stop slots 24 are configured to secure a separate right door stop 72 to the underside 21 of the central web at 20 of the header 12.

Figure 6:
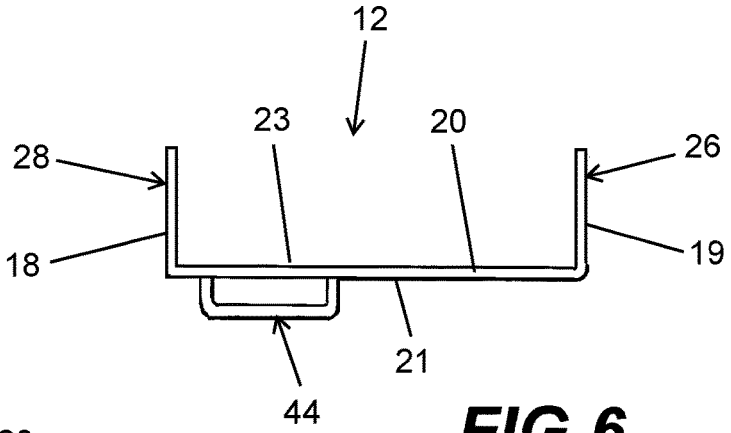
FIG. 6 is an enlarged section view of the left end of the header of the double egress door frame as seen along the line 6-6 of FIG. 3 in accordance with the present invention.
Figure 5:
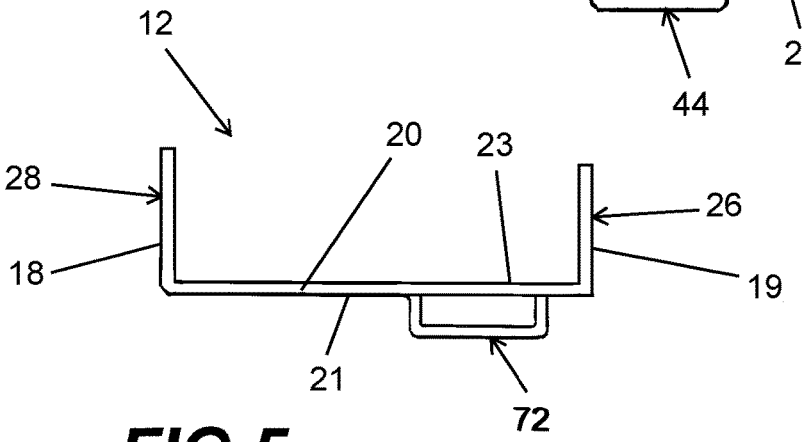
FIG. 5 is an enlarged section view of the right end of the header of the double egress door frame as seen along the line 5-5 of FIG. 3 in accordance with the present invention.

FIG. 5 shows the profile of the header 12 on the right side of the header 12. FIG. 6 shows the profile of the header 12 on the left side of the header 12. Particularly, with respect to FIG. 5, the separate right door stop 72 is shown attached to the underside 21 of the web 20 and offset in the front width direction toward the front 26 of the header 12. Likewise, FIG. 6 shows the left door stop 44 attached to the underside 21 of the web 20 and offset in the back width direction toward the back 28 of the header 12.

Figure 8:
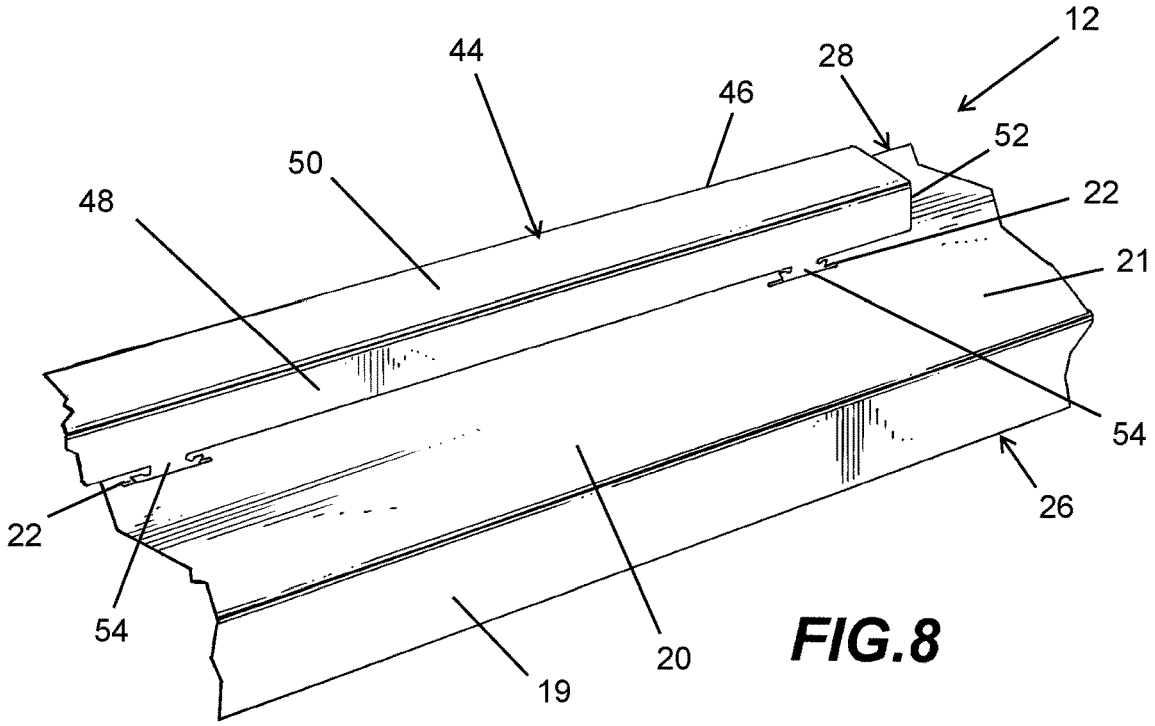
FIG. 8 is an enlarged perspective view of a portion of the header with the separate left door stop partially inserted into the underside of the central web of the double egress door frame in accordance with the present invention.
Figure 9:
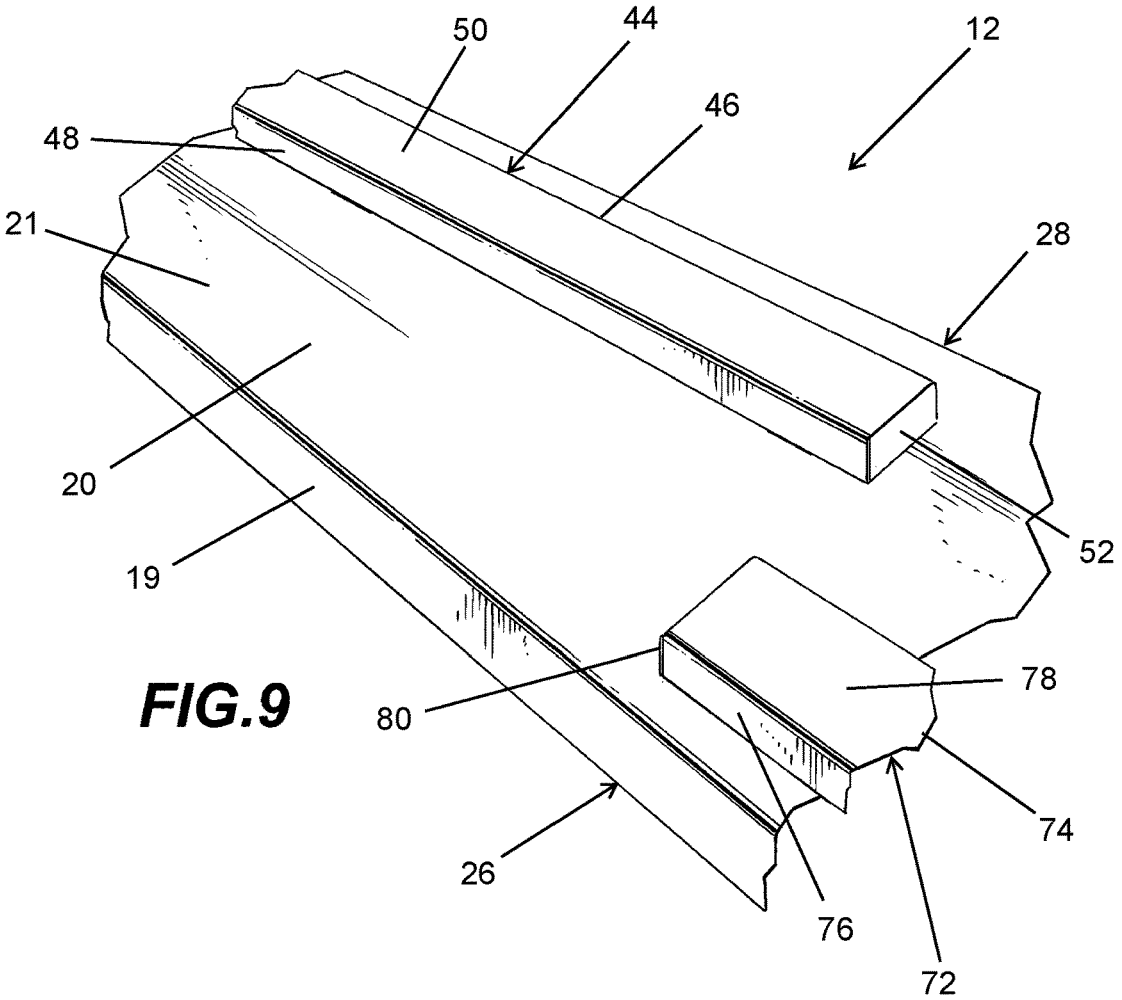
FIG. 9 is an enlarged perspective view of a portion of the header with the separate left door stop and the separate right door stop attached to the underside of the central web of the double egress door frame in accordance with the present invention.

With reference to FIGS. 8 and 9, the separate left door stop 44 is an elongated channel-shaped member 46. As seen in FIG. 8, the left channel-shaped member 46 comprises left channel sides 48, a left channel bottom 50, and left channel ends 52. Left channel tabs 54 extend from the left channel sides 48 toward the left door stop slots 22 in the web 20 of the header 12. The left channel tabs 54 have tab ears 55. FIG. 9 shows the elongated channel-shaped member 46 fully engaged with the left door stop slots 22 of the web 20 of the header 12.

Figure 7:
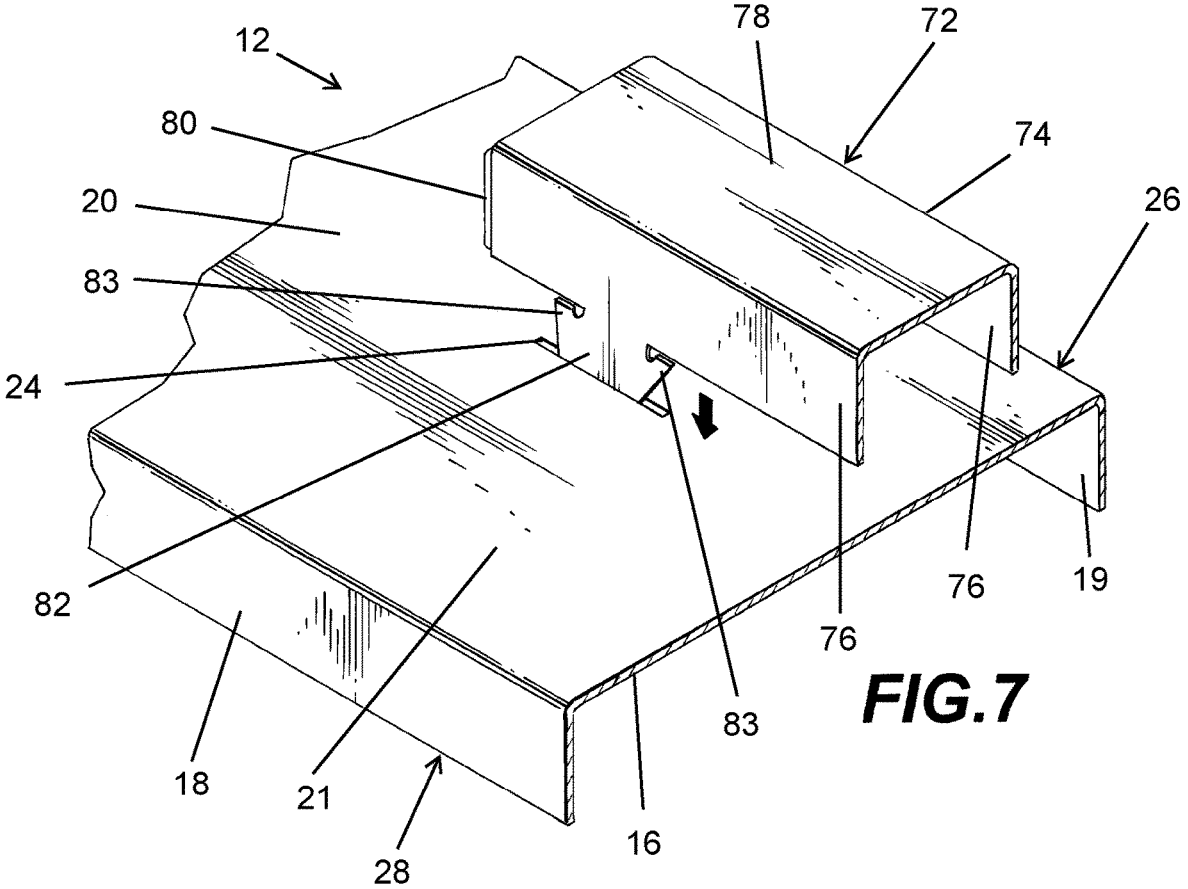
FIG. 7 is an enlarged perspective view of a portion of the header with the separate right door stop partially inserted into the underside of the central web of the double egress door frame in accordance with the present invention.

Similarly, with reference to FIG. 7, the right door stop 72 is an elongated channel-shaped member 74. The right channel-shaped member 74 comprises right channel sides 76, a right channel bottom 78, and right channel ends 80. Right channel tabs 82 extend from the right channel sides 76 toward the right door stop slots 24 in the web 20 of the header 12. The right channel tabs 82 have tab ears 83. FIG. 9 shows the elongated channel-shaped member 74 fully engaged with the right door stop slots 24 of the web 20 of the header 12.

Figure 10:
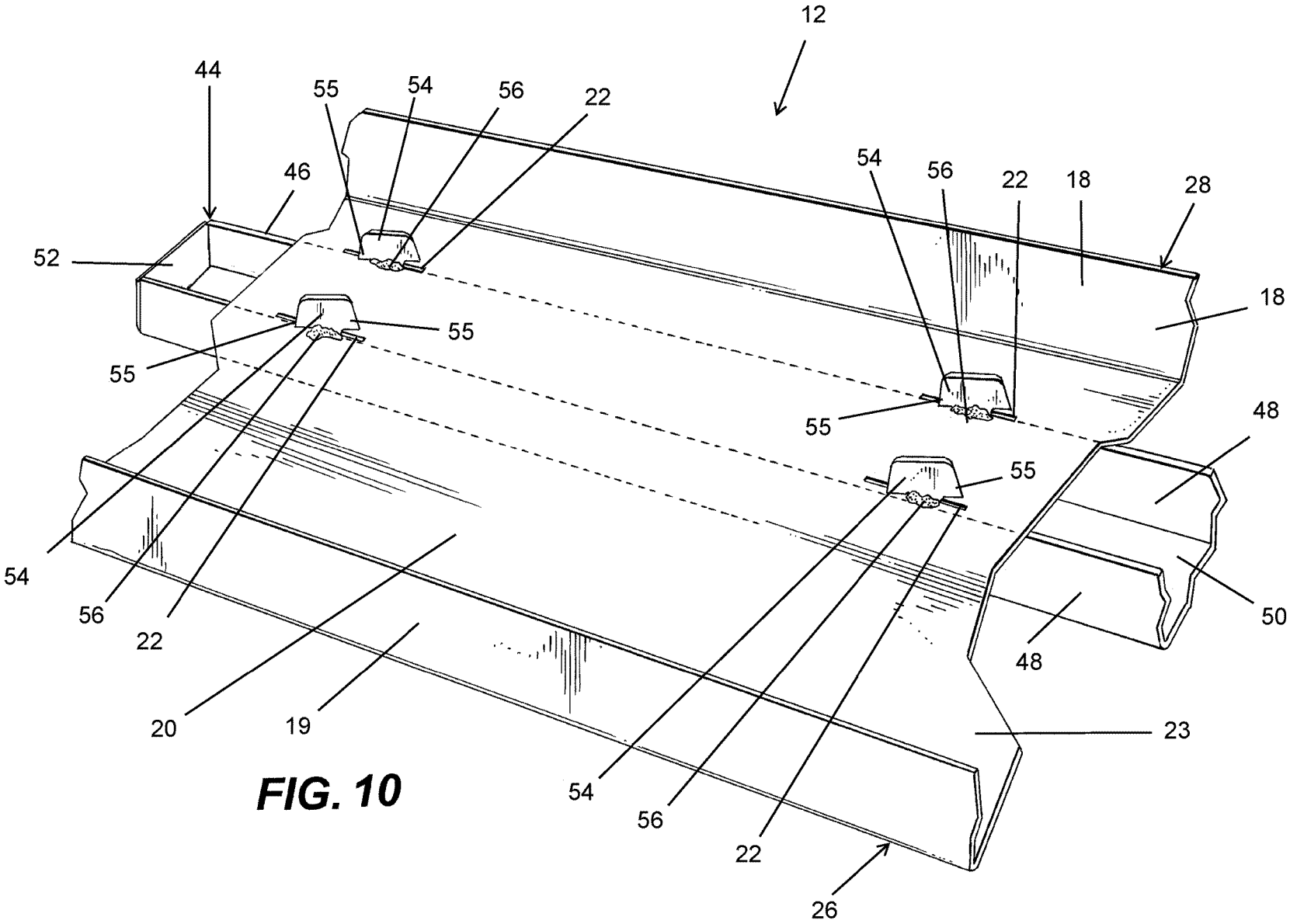
FIG. 10 is an enlarged perspective view of a portion of the header with the separate left door stop of the double egress door frame in accordance with the present invention.

FIG. 10 shows the top of the header 12 with the left channel-shaped member 46 attached to the underside 21 of the web 20 of the header 12. Particularly, the left channel tabs 54 are shown protruding through the left door stop slots 22. Once the left channel tabs 54 have been fully inserted through the left door stop slots 22, the tabs 54 are twisted so that the tab ears 55 engage the top side 23 of the web 20 thereby holding the left elongated channel-shaped member 46 in place on the underside 21 of the central web 20 and thus forming the separate left door stop 44. In order to ensure a solid and rattle proof connection of the channel-shaped member 46 to the central web 20 of the header 12, spot welds 56 are made where the tabs 54 engages the top side 23 of the central web 20.

Because the spot welding does not create a substantial amount of heat in the manufacture of the header 12, the header 12 including the central web 20 and channel sides 18 and 19 can be made of a lighter gauge steel than a double egress door frame header that is created by welding two reversed sections of header stock together at the middle of the header. Particularly, the standard steel gauge for conventional welded header is 16 gauge. When the present invention is employed, the steel gauge for the header can be reduced to 18 gauge.

In addition to savings of material based on the use of lighter gauge steel, the manufacturing process is expedited by the present invention. First, the channel-shaped header 12 with slots 22 and 24 is a simple cutting and stamping process. Further, minimum skill is required to insert and bend the tabs of the channel-shaped members. Moreover, spot welding the tabs to the central web 20 of the header 12 requires substantially less welding skill, and less time is required to complete the spot welds as compared to clamping and welding two separate header sections together the middle.

While this invention has been described with reference to preferred embodiments thereof, it is to be understood that variations and modifications can be affected within the spirit and scope of the invention as described herein and as described in the appended claims.

We claim:

1. In a double egress door frame that includes a header having a length, a width, a back width direction, a front width direction, a left end, and a right end, the header connected at its left end to a left door jamb for supporting a left door by left door hinges, and the header connected at its right end to a right door jamb for supporting a right door by right door hinges, the header comprising:

a. a central web with an underside and a top side;

b. a separate left door stop attached to a left header portion of the underside of the central web and offset in the back width direction; and c. a separate right door stop attached to a right header portion of the underside of the central web and offset in the front width direction, wherein the separate left door stop engages the left door when the left door is in a closed position, and the separate right door stop engages the right door when the right door is in a closed position.

2. The header of claim 1, wherein:

a. the central web includes:

i. a first plurality of slots extending along the left header portion of the header and offset in the back width direction along the width; and ii. a second plurality of slots extending along the right header portion of the header and offset in the front width direction along the width, wherein the back width direction is opposite that of the front width direction;

b. the separate left door stop has first tabs that engage the first plurality of slots; and c. the separate right door stop has second tabs that engage the second plurality of slots, wherein the separate left door stop engages the left door when the left door is in the closed position, and the separate right door stop engages the right door when the right door is in the closed position.

3. The header of claim 2, wherein the first tabs and the second tabs, having engaged the first and second plurality of slots, are twisted to hold the separate left door stop and the separate right door stop in place against the underside of the central web.

4. The header of claim 3, wherein the first tabs and the second tabs have tab ears that engage the top side of the central web when the first tabs and the second tabs are twisted.

5. The header of claim 3, wherein the twisted first tabs and second tabs are spot welded to the top side of the central web.

* * * * *